US012589834B2

(12) United States Patent
Grall

(10) Patent No.: US 12,589,834 B2
(45) Date of Patent: Mar. 31, 2026

(54) DEVICE FOR CONNECTING TWO PARTS OF A HULL OF A SHIP, AND HULL OF A SHIP COMPRISING SUCH A DEVICE

(71) Applicant: IXBLUE, Saint-Germain-en-Laye (FR)

(72) Inventor: Sébastien Grall, Saint-Germain-en-Laye (FR)

(73) Assignee: EXAIL, Saint-Germain-en-Laye (FR)

( * ) Notice: Subject to any disclaimer, the term of this patent is extended or adjusted under 35 U.S.C. 154(b) by 769 days.

(21) Appl. No.: 17/797,356

(22) PCT Filed: Feb. 1, 2021

(86) PCT No.: PCT/EP2021/052319
§ 371 (c)(1),
(2) Date: Aug. 3, 2022

(87) PCT Pub. No.: WO2021/156208
PCT Pub. Date: Aug. 12, 2021

(65) Prior Publication Data

US 2023/0062865 A1 Mar. 2, 2023

(30) Foreign Application Priority Data

Feb. 3, 2020 (FR) ..... 2001065

(51) Int. Cl.
*B63B 3/08* (2006.01)
*B63B 7/04* (2020.01)

(52) U.S. Cl.
CPC . *B63B 3/08* (2013.01); *B63B 7/04* (2013.01)

(58) Field of Classification Search
CPC .... B63B 3/00; B63B 3/02; B63B 3/08; B63B 2003/145; B63B 7/00; B63B 7/02; B63B 7/04
(Continued)

(56) References Cited

U.S. PATENT DOCUMENTS 2,328,693 A 9/1943 Taylor
2,584,685 A 2/1952 Evert
(Continued)

FOREIGN PATENT DOCUMENTS

FR 2 970 306 7/2012

OTHER PUBLICATIONS

International Search Report dated Apr. 6, 2021, for PCT/EP2021/052319, 6 pp., including English translation.
(Continued)

*Primary Examiner* — Daniel V Venne
(74) *Attorney, Agent, or Firm* — NIXON & VANDERHYE

(57) ABSTRACT

Disclosed is a device for connecting two parts of a ship hull, including: a first frame intended to be integral with a first part of the hull; a second frame intended to be integral with a second part of the hull; a tenon integral with the first frame; a mortise arranged in the second frame and able to receive the tenon as a result of a relative translation of the two frames towards each other in a longitudinal direction of insertion; and a pin which is able to be engaged, on the one hand, into a transverse housing provided in the second frame and opening into the mortise and, on the other hand, into a transverse through-hole provided in the tenon, so as to hold the tenon in the mortise. Also disclosed is a hull of a ship including such a device.

18 Claims, 4 Drawing Sheets

(58) Field of Classification Search
USPC ..... 114/343, 352
See application file for complete search history.

(56) References Cited

U.S. PATENT DOCUMENTS

| | | | | |
|---|---|---|---|---|
| 3,409,920 | A * | 11/1968 | Brownley | B63B 32/53 441/74 |
| 4,807,549 | A * | 2/1989 | Rhodes | B63B 32/53 441/74 |
| 2005/0148248 | A1 | 7/2005 | Katzfey | |

OTHER PUBLICATIONS

Written Opinion of the ISA dated Apr. 6, 2021, for PCT/EP2021/052319, 12 pp., including English translation.

* cited by examiner

Fig.3
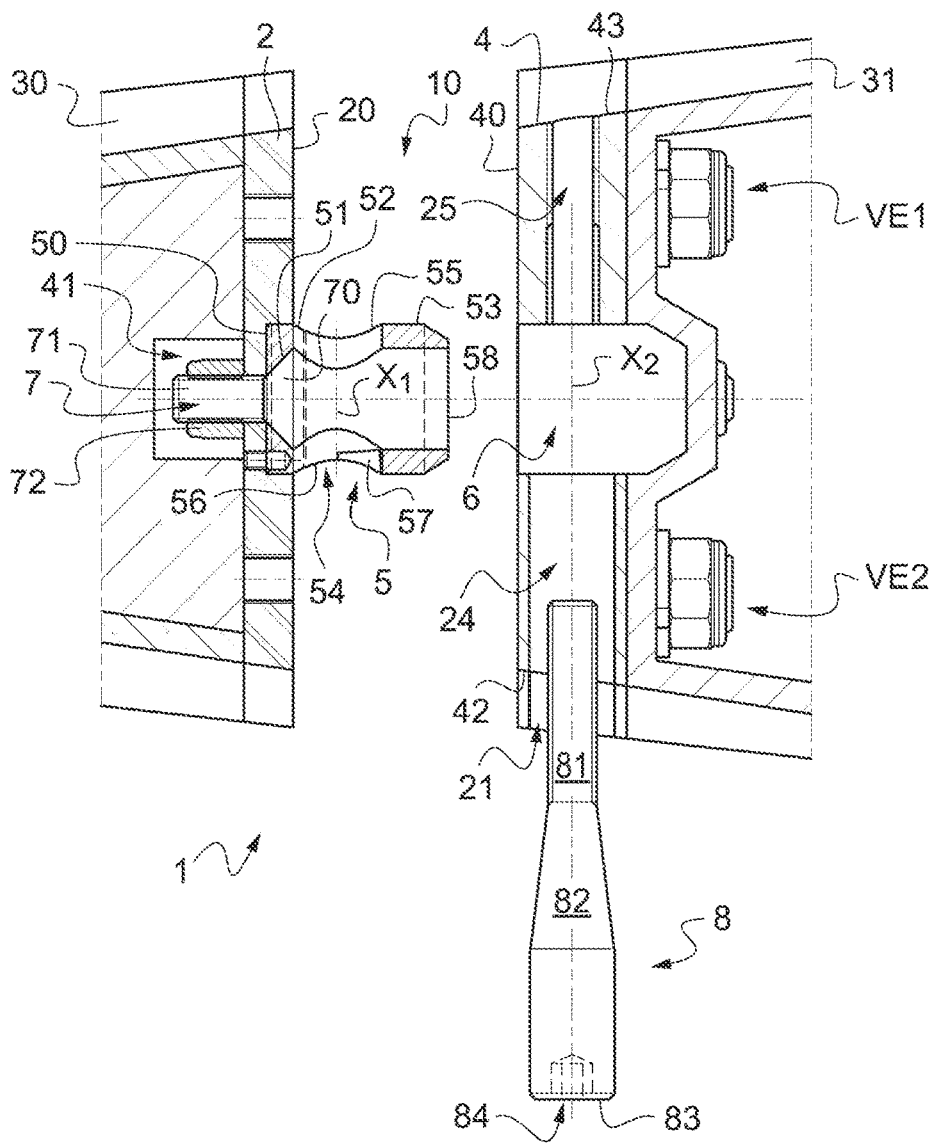
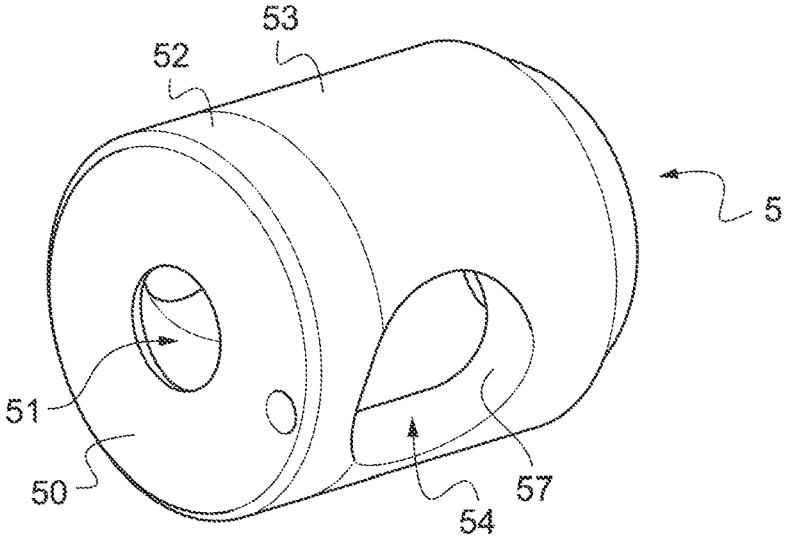
Fig.4

DEVICE FOR CONNECTING TWO PARTS OF A HULL OF A SHIP, AND HULL OF A SHIP COMPRISING SUCH A DEVICE

This application is the U.S. national phase of International Application No. PCT/EP2021/052319 filed Feb. 1, 2021, which designated the U.S. and claims priority to FR 2001065 filed Feb. 3, 2020, the entire contents of each of which are hereby incorporated by reference.

TECHNICAL FIELD

The present invention relates to the field of shipbuilding and has more particularly for object a device for connecting two parts of a ship hull, as well as a ship hull comprising such a device.

TECHNOLOGICAL BACKGROUND

It is known to equip ship hulls with a collision box, commonly referred to as "Crash Box" by the person skilled in the art, in order to absorb shocks in case of collision and to avoid that the rest of the hull suffers damages.

It is hence usual that in case of significant shock, le crash box is totally or partially destroyed. Although the destruction of the box does not prevent the ship from sailing, it is nevertheless advisable to replace it in order to anticipate for futures collisions and to restore hydrodynamic performance of the ship.

Conventionally, the collision box is incorporated to the ship hull, typically the front part thereof to form the stem. It includes a core fastened to the hull, for example by screwing and/or by bonding, and is covered with a coating that is common to the box and the rest of the hull. The means for fastening the box to the hull are covered with this coating and are hence not accessible.

Replacing the crash box so that it is again properly incorporated into the hull thus involves making again partially the coating of the hull in order to reform the continuity of material between the box and the rest of the hull. In particular, the hull has to be repainted and the repair thus requires the ship to be taken out of the water. The operation further requires specialized workforce. It is therefore a lengthy process liable to require several days of immobilization of the ship. In certain marine applications, for example scientific applications, the ships are specifically equipped or designed for a determined function and the use of a replacement ship is excluded. In this case, a long-term immobilization of the ship is particularly disadvantageous.

SUMMARY OF THE INVENTION

According to the invention, it is proposed a device for connecting two parts of a ship hull, comprising:

- a first frame intended to be integral with a first part of the hull,
- a second frame intended to be integral with a second part of the hull,
- a tenon integral with the first frame,
- a mortise provided in the second frame and able to receive the tenon as a result of a relative translation of the two frames towards each other in a longitudinal direction of insertion,
- a pin which is adapted to be engaged, on the one hand, into a transverse housing provided in the second frame and opening into said mortise and, on the other hand, into a transverse through-hole provided in the tenon, so as to hold the tenon in the mortise.

The connecting device according to the invention hence allows easy installation and removal of the two frames, and is especially adapted to the fastening of a crash box on a ship hull because the pin extends in the second frame in a non-orthogonal manner with respect to the second face, and preferentially parallel to the second face; the box is thus not passed-through by rigid elements that would hinder the shock damping function thereof.

According to an embodiment, the pin and the tenon hole are arranged in such a way as to create a ramp effect causing a clamping of the two frames towards each other in the longitudinal direction as a result of a transverse effort of insertion of the pin into said transverse through-hole.

A ramp, also called linear cam, that transforms a translational motion into a transverse, and in particular orthogonal, translational motion, is particularly suitable means of achieving good clamping control. In particular, a linear cam here allows a more sensitive and reliable adjustment than with a conventional cam, that is to say a cam that transforms a rotational motion into a translational motion.

According to an alternative of this embodiment, the pin comprises a tapered portion playing a role in the ramp effect, said transverse through-hole and said transverse housing being configured to have distinct axes when the tenon is inserted into the mortise.

The pin may comprise a threaded portion adapted to engage into a tapped portion of the transverse housing of the second frame.

The screwing is a reliable means for fastening the pin, further allowing a good control of translation of the pin in the second frame, and hence a good clamping control.

According to an alternative, the tenon has a proximal portion of suitable size for insertion without play into the mortise and a distal portion of suitable size for insertion with play into the mortise.

The words "distal" and "proximal" here refer to positions of the portions relative to the first frame. Therefore, the proximal portion is the portion that is the closest to the first frame and the distal portion is the portion that is the farthest from the first frame.

The distal portion thus allows easy insertion of the tenon into the mortise and the proximal portion adjusted to the mortise allows centring the first and the second frames.

According to an embodiment, the tenon has a cylindrical shape.

According to an embodiment, the tenon is screwed to the first frame.

Screw fastening is a simple way to make the tenon, which may then be easily replaced.

According to another aspect, it is proposed a ship hull comprising a first part and a second part connected to each other by a connecting device according to the invention.

According to an embodiment of this aspect, the first part of the hull is a cash box and the first frame includes a central area for the fastening of a core of said box and a peripheral area comprising at least one fastening aperture opening in a first face of the first frame and in a rear face of the frame opposite to the first face.

The different features, alternatives and embodiments of the invention can be associated with each other according to various combinations, insofar as they are not incompatible or exclusive with respect to each other.

BRIEF DESCRIPTION OF THE DRAWINGS

Moreover, various other features of the invention emerge from the appended description made with reference to the drawings that illustrate non-limiting embodiments of the invention, and wherein:

FIG. 3 is a cross-sectional view of the connecting device of FIG. 1 along section line II-II, FIG. 4 is a perspective view of the tenon of the connecting device of FIGS. 1 to 3.

It is to be noted that, in these figures, the structural and/or functional elements common to the different alternatives can have the same references numbers.

DETAILED DESCRIPTION

Figure 1:
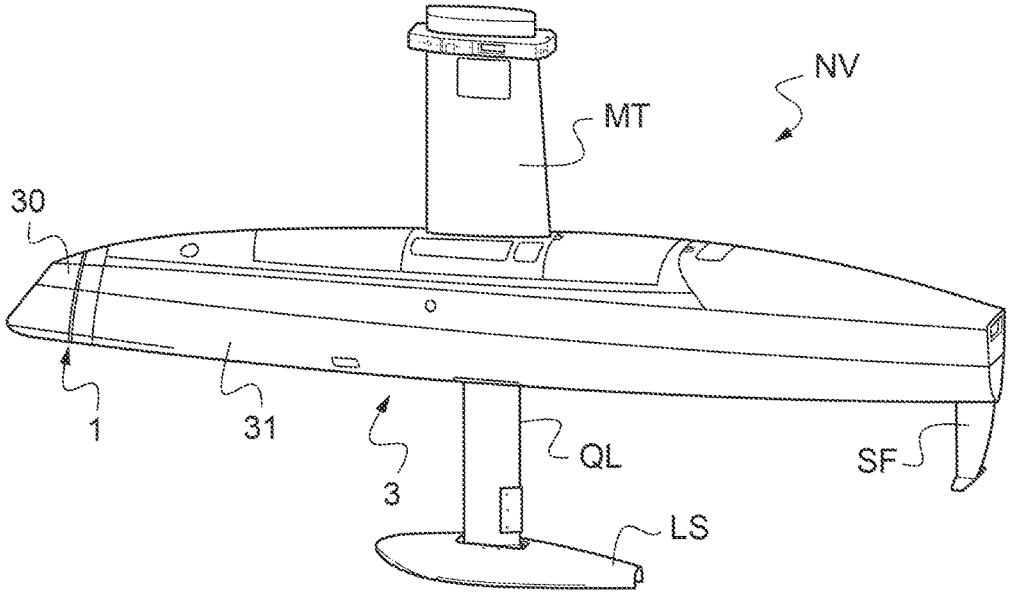
FIG. 1 is a perspective view of a ship whose hull has a first part and a second part that are connected to each other by a connecting device according to the invention.

FIG. 1 is a perspective view of a ship NV, here an unmanned autonomous ship, including a hull 3, a keel QL equipped with a ballast LS, a rudder blade SF and a mast MT.

The hull 3 here comprises a first part 30, here a crash box that forms the stem of the hull 3, and a second part 31 that extends from the first part to the rear of the ship, or sternpost.

The first part 30 and the second part 31 of the hull 3 are connected by a connection device referred to by the reference sign 1 and illustrated in more detail in FIGS. 2 to 8.

Figure 2:
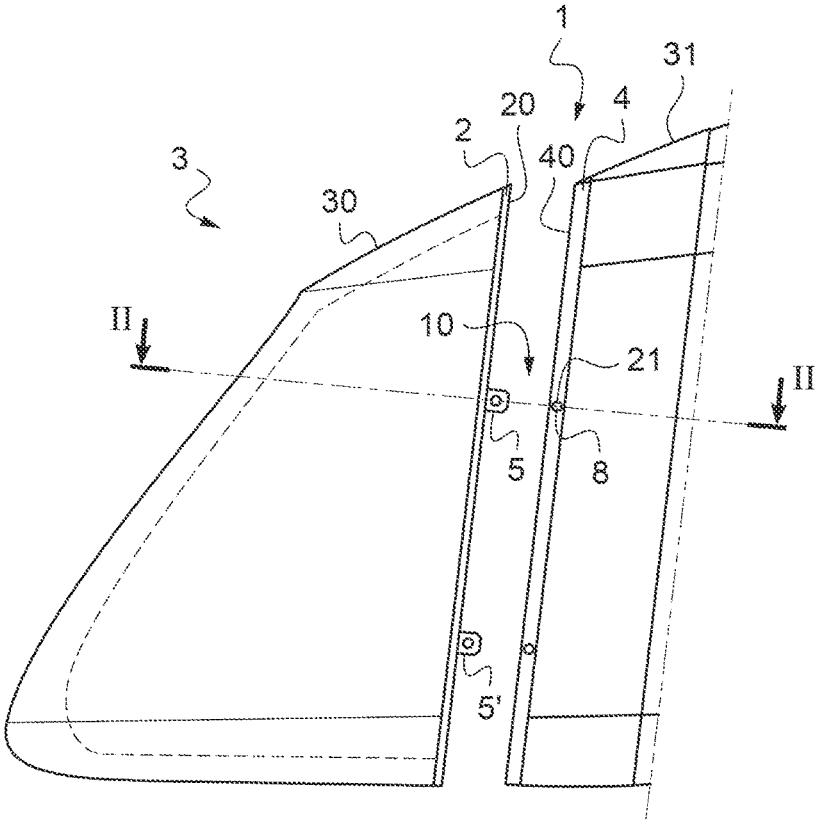
FIG. 2 is a side view of the front of the ship hull of FIG. 1, the elements of the connecting device being separated from each other.

As illustrated in FIGS. 2 and 3, the connecting device 1 comprises a first frame 2 integral with the first part 30 of the hull 3 of the ship NV. The fastening of the first part 30 of the hull 3 to the first frame 2 is here made by means of screws passing through the first frame 2 and the first part 30 of the hull 3, as well as by mechanical anchoring as will be seen in the following of the description.

The connecting device 1 comprises a second frame 4 integral with the second part 31 of the ship hull 3. The fastening of the second frame 4 of the second part 31 of the hull 3 is here made by clamping by means of screw-nut systems VE1, VE2, two of which are shown in FIG. 3.

A first face 20 of the first frame 2 and a second face 40 of the second frame 4 are configured to establish a contact surface. The contact between the first face 20 and the second face 40 is maintained by two tenon-mortise systems of the connecting device, a single one of which, the tenon-mortise system 10, will be described hereinafter for the sake of simplification.

Therefore, a tenon 5 extends from the first fame 2 is such a way as to protrude from the first face 20. Here, the tenon 5 is generally cylindrical, has a length of 30 millimetres and a proximal end 50 of the tenon 5 is fastened to the first frame 2. FIG. 4 is a perspective view of the tenon 5 isolated from the rest of the device, shown here to facilitate understanding of the invention.

For example, here, the proximal end of the tenon 5 comprises a countersink 51 adapted to receive a countersunk head 70 of a screw 7, and the tenon 5 is fastened to the first frame 2 by said screw 7, a threaded rod 71 of which cooperates with a nut 72 in such a way as to maintain the tenon 5 against the first frame 2 by clamping. Here, a cavity 41 is provided in the first part 30 of the hull 3 to receive the nut 72 and a portion of the threaded rod 71.

The tenon 5 has a proximal portion 52 extending from the proximal end 50, here over a length of 6 millimetres, and having a diameter of 25 millimetres, and a distal portion 53 extending from the proximal portion 52 over a length of 24 millimetres and having a diameter slightly smaller than the diameter of the proximal portion 52, here a diameter of 24.8 millimetres.

The tenon 5 here comprises a transverse through-hole 54 provided transverse to the tenon 5, here orthogonal to the axis of the tenon, that is to say here parallel to the first face 20. Therefore, the tenon 5 comprises two circular orifices 55, 56 sharing a same first axis X1 and provided in the lateral wall thereof. A first orifice 55 has a diameter equal to 14.5 millimetres.

A seconds orifice 56 includes a countersink 57 and has a diameter at the internal surface of the tenon that is equal to 14.5 millimetres and a maximum size at the external surface of the tenon that is equal to 15 millimetres.

The transverse through-hole 54 is made in such a way as to be closer to the proximal end 50 than a distal end 58 of the tenon 5 opposite to the proximal end 50. Therefore, the edge of the transverse through-hole 54 is located at a distance of 4.2 millimetres from the proximal end 50 and at a distance of 11.3 millimetres from the distal end 58.

A mortise 6 is provided in the second frame 4 at the second face 40. Here, the mortise is cylindrical and has a diameter substantially equal to the diameter of the proximal portion 52 in such a way that, when the first frame 2 and the second frame 4 establish the contact surface, the tenon 5 is inserted into the mortise in an adjusted manner. Here, the mortise 6 is a through mortise.

The second frame 4 comprises a transverse housing 21 that extends parallel to the second face 40 by passing through the mortise 6 and that opens at a first edge 42 of the second frame 4 and at a second edge 43 of the second frame 4 opposite to the first edge 42.

The transverse housing 21 is here a cylindrical hole extending along a second axis X2 and a first part 24 of which, located between the first edge 42 and the mortise 6, has a first diameter, and a second part 25 (or tapped portion 25) of which, located between the second edge 43 and the mortise 6, has a second diameter lower than the first diameter. For example, the first diameter is here equal to 14 millimetres, and the second diameter is here equal to 8 millimetres. The second part 25 of the transverse housing 21 is here tapped.

The connecting device 1 further includes a pin 8 configured to be inserted into the transverse housing 21. The pin 8 here has a generally cylindrical shape and comprises three portions 80, 81, 82 of distinct diameters.

A first portion 80 of the cylindrical pin has a constant diameter slightly smaller than the first diameter of the transverse housing 21, here a diameter of 14.2 millimetres. The first portion 80 comprises a first end 83 of the pin, in which a screw imprint 84 is formed, here a hexagonal hollow imprint (shown transparently in dotted lines in FIG. 3). Said imprint 84 is configured to cooperate with a screwing tool, for example a hexagonal key.

A second portion 81 (or threaded portion 81) of the pin 8 has a constant diameter slightly smaller than the second diameter of the second part 25 of the transverse housing 21, here a diameter of 8 millimetres. Moreover, the second portion 81 is threaded and configured to cooperate with the second, tapped part 25 of the transverse housing 21.

The pin 8 further comprises an intermediate portion 82 located between the first portion 80 and the second portion 81. The intermediate portion 82 has a diameter that varies with its length; for example, here, the intermediate portion 82 is tapered and has a diameter that decreases linearly from the first portion 80 towards the second portion 81. Here, the intermediate portion 82 has a maximum diameter equal to the diameter of the first portion 80 and a minimum diameter equal to the diameter of the second portion 81.

Figure 5:
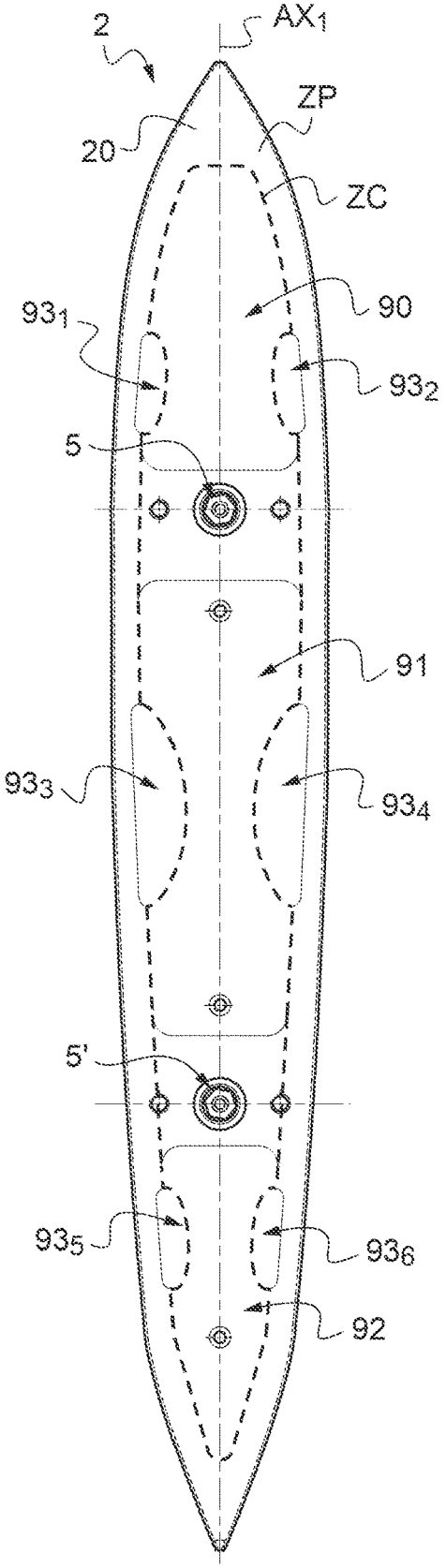
FIG. 5 is a view of a first face of a first frame of the connecting device of FIGS. 1 to 3.

As illustrated in FIG. 5, the first frame 2 is a plate with a contour that fits that of the first part of the hull, here a fusiform contour, having a length of 745 millimetres, a maximum width of 115 millimetres, a thickness of 18 millimetres, and having a first axis of symmetry AX1 extending over its length.

The first frame 2 includes a central area ZC configured to receive a core of the crash box, a peripheral area ZP configured to receive a coating of the crash box core, for example a resin.

The central area ZC includes three recesses 90, 91, 92 having here a depth of 15.5 millimetres. The recesses are configured to reinforce the connection between the frame 2 and the crash box core by means of the resin surrounding the core. This resin, that surrounds the core, also fills the recesses 90, 91 and 92. The frame 2 is hence connected to the core by means of the resin. The recesses further allow lighten the first frame 2.

The tenon 5 of the tenon-mortise system described hereinabove is located between a first recess 90 and a second recess 91. A second tenon 5' of a second tenon-mortise system is located between the second recess 91 and a third recess 92.

The peripheral area ZP further includes fastening apertures $\mathbf{93}_1$ to $\mathbf{93}_6$, opening in the first face 20 and in a rear face (not shown in FIG. 5) of the first frame 2 that is opposite to the first face 20.

The fastening apertures $\mathbf{93}_1$ to $\mathbf{93}_6$ allows, during the making of the crash box coating, conventionally by casting a resin into a mould temporarily arranged about the core, the resin to flow on the other side of the first frame 2, at the rear face. Therefore, the resin spreads on either side of the first frame and forms a mechanical anchoring with the first frame 2, improving the fastening of the cash box to the first frame 2.

Figure 6:
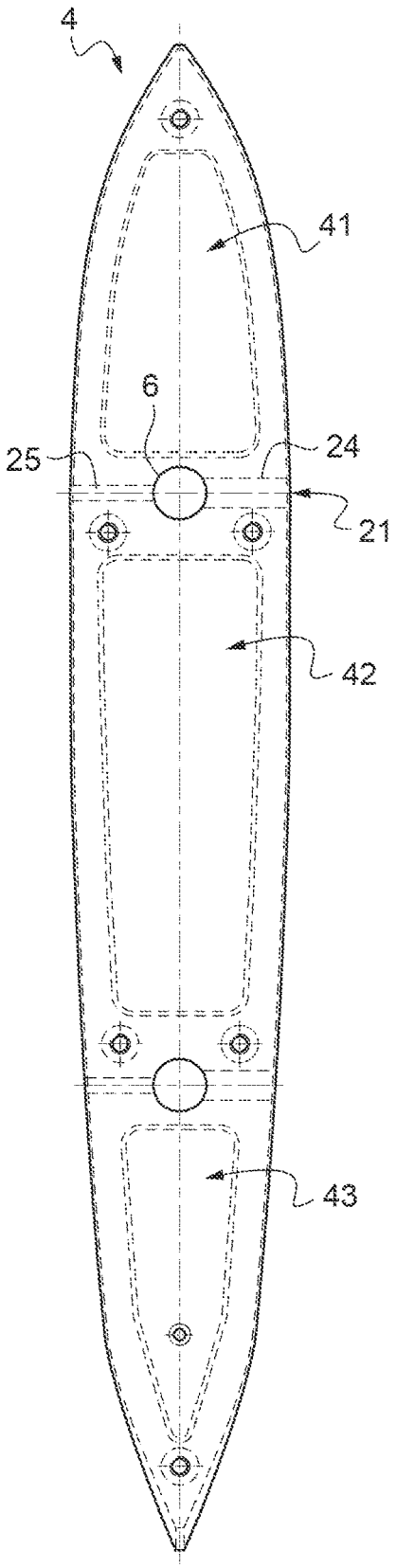
FIG. 6 is a view of a second face of a second frame of the connecting device of FIGS. 1 to 3.

As illustrated in FIG. 6, the second frame 4 has contour and size that are substantially identical to those of the first frame 2, and also includes three recesses 41, 42, 43 identical to the recesses 90, 91 and 92 of the first frame 2 and having for function to lighten the second frame 4.

It is to be noted here that the second frame has no axis of symmetry because the transverse housing 21 has a first part 24 and a second part 25 that are different from each other.

Figure 7:
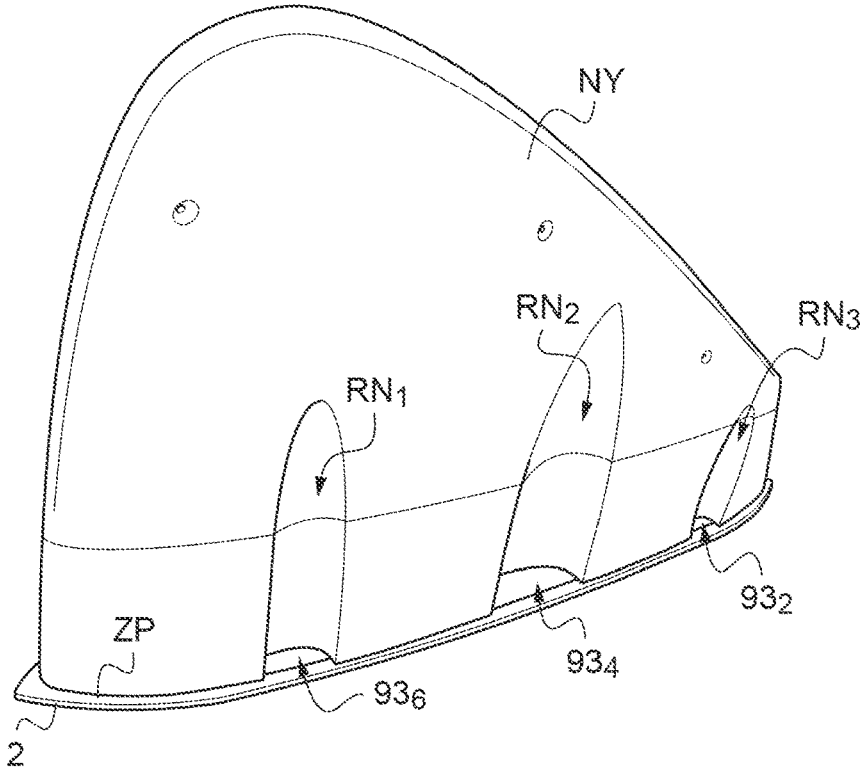
FIG. 7 is a perspective view of the first frame to which is fastened a core of a crash box.

FIG. 7 illustrates the first frame 2, the central part of which includes a core NY of a crash box, previously to the making of the coating. Therefore, the peripheral areal ZP of the frame is here devoid of coating. It is to be noted here that the core NY comprises six grooves, three grooves $RN_1$ to $RN_3$ of which are visible in FIG. 7, fitting partially the contours of the corresponding fastening apertures $\mathbf{93}_2$, $\mathbf{93}_4$ and $\mathbf{93}_6$. These grooves allow the coating resin to flow more easily in the fastening apertures.

The connecting device 1 according to the invention may be made of any material, and preferentially of a corrosion and oxidation resistant material. In the example described here, and preferentially, the first frame 2 and the second frame 4 are made of a titanium alloy and the other elements of the connecting device are made of stainless steel.

During the use of the connecting device 1 as described hereinabove, the contact surface between the first face 20 and the second face 40 is established by inserting the tenon 5 into the mortise 6. The smaller diameter of the distal part 53 of the tenon 5 allows an insertion with play of the tenon into the mortise 6, and hence an easier insertion. The proximal portion 52 allows an insertion without play, that is to say adjusted, of the tenon 5 into the mortise 6 when the contact surface is established.

Then, in order to maintain the contact surface, the pin 8 is inserted into the transverse housing 21 in such a way that the tapered intermediate portion 82 is located in the transverse through-hole 54.

In particular, the pin 8 is first translated by sliding in the first part of the transverse housing through the mortise 6, up to the second part 25, then the second portion 81 is screwed in the second part using the imprint 84, in such a way as to translate the pin 8 in a controlled manner.

Therefore, the intermediate part 82 of the pin 8 bears against the countersink 57 of the second orifice 56 and pushes the tenon 5 into the mortise 6. In other words, the intermediate portion 82 here creates a ramp effect, or linear cam, and transforms the translational motion of the pin 8, which is a motion parallel to the second face 40, into a translational motion of the tenon 5 into the mortise 6, and hence a motion of the first frame 2 towards the second frame, that is to say a motion orthogonal to the translational motion of the pin 8. The clamping force of the first face 20 against the second face 40 therefore depends on the position of the pin 8 in the orifice 21 and is adjustable by screwing. It is to be noted, here, that the first axis X1 and the second axis X2 are distinct from each other, in particular once the contact surface established between the first face 20 and the second face 40. In other words, the transverse through-hole 54 and the transverse housing 21 are not coaxial to each other.

Here, the screw imprint 84 is advantageously accessible from the first edge 42 of the second frame 4. And the pin 8 is here configured not to extend out of the second frame 4, in order not to compromise the hydrodynamic performances of the ship.

It is to be noted here that if the countersink 57 of the second orifice 56 allows a better contact intimacy between the tapered intermediate portion 82 and the second orifice 56. In particular, the countersink 57 allows increasing the contact surface in order to avoid a matting of the contact surface.

It is thus advantageously possible to adjust the clamping of the first face 20 against the second face 40 by adjusting by screwing the translation of the pin 8 in the transverse housing 21.

Figure 8:
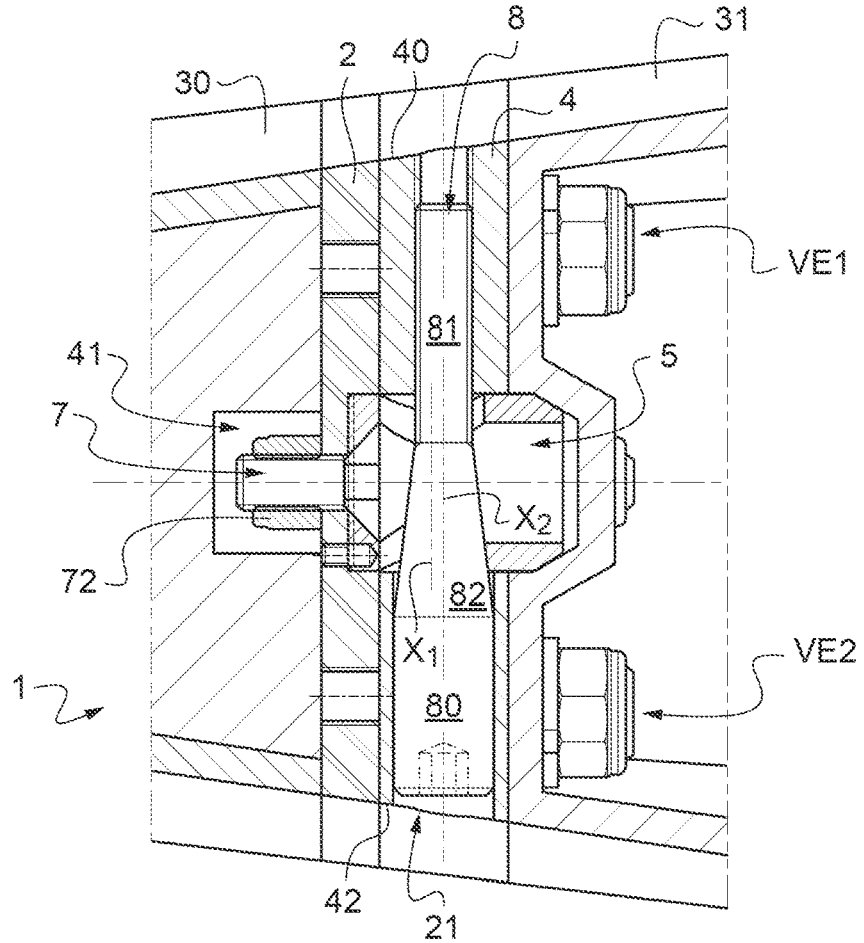
FIG. 8 illustrates a second configuration of the device of FIG. 3, in which the elements of the device are assembled to each other.

FIG. 8 shows a second configuration of the device in which the contact surface is established between the first face 20 and the second face 40 and in which the clamping is ensured by the tenon-mortise system 10.

The pin 8 of the device 1 described hereinabove in connection with FIGS. 1 à 8 includes the tapered intermediate portion 82 acting as a cam and advantageously ensuring a control on the clamping. However, the invention is not limited to a pin including a cam and, according to other alternative embodiments, the pin and the transverse housing 21 have constant diameters. According to these alternatives, the relative position of the transverse housing 21 and the transverse hole is adjusted in such a way as to ensure the contact surface between the first face 20 and the second face 40.

The invention further covers certain alternatives in which the intermediate portion includes a different linear cam. For example, the diameter of the intermediate portion could decrease in a non-linear manner. According to another alternative, the cam in not linear and the pin has an eccentric.

Moreover, in the example described, the pin 8 is fastened in the second frame 4 by screwing of its second portion 81 into the second part 25 of the transverse housing, advantageously allowing a precise control of the clamping. The invention is however not limited to this fastening mode and is compatible with any fastening means. For example, according to an alternative, the pin can cooperate with the second frame by any other fastening system, for example of the peg type or bayonet type. The invention covers for example a clamping device in which the second portion 81 of the pin 8 has a bayonet-type fastening and wherein the intermediate portion 82 has an eccentric.

The above-described tenon 5 is fastened to the first frame 2 through a screw-nut system. According to alternative embodiments, the tenon 5 may be fastened to the first frame 2 by any suitable means, in particular by welding.

Finally, although a connecting device made of stainless steel and titanium has been described here, the device may be made of any material and in particular the device may be made of a single material or more than two different materials.

Various other modifications may be made to the invention within the scope of the appended claims.

The invention claimed is:

1. A ship hull comprising a first part and a second part, the first part of the ship hull being a crash box, the first part and the second part being connected to each other by a device comprising:

a first frame integral with the first part of the ship hull, a second frame integral with the second part of the ship hull, a tenon integral with the first frame, a mortise arranged in the second frame and able to receive the tenon as a result of a relative translation of the first frame and the second frame towards each other in a longitudinal direction of insertion, and a pin which is able to be engaged, into a transverse housing provided in the second frame and opening into said mortise and into a transverse through-hole provided in the tenon, so as to hold the tenon in the mortise, wherein the first frame includes a central area for fastening a core of said crash box and a peripheral area comprising at least one fastening aperture opening in a first face of the first frame and in a rear face of the first frame opposite to the first face.

2. The ship hull according to claim 1, wherein the pin and the through-hole of the tenon are arranged in such a way as to create a ramp effect causing a clamping of the first frame and the second frame towards each other in a longitudinal direction as a result of a transverse effort of insertion of the pin into said transverse through-hole.

3. The ship hull according to claim 2, wherein the pin includes a tapered portion playing a role in the ramp effect, said transverse through-hole and the transverse housing being configured to have distinct axes when the tenon is inserted into the mortise.

4. The ship hull according to claim 1, wherein the pin includes a threaded portion adapted to engage into a tapped portion of the transverse housing of the second frame.

5. The ship hull according to claim 1, wherein the tenon has a proximal portion having a suitable size for insertion without play into the mortise and a distal portion having a suitable size for insertion with play into the mortise.

6. The ship hull according to claim 1, wherein the tenon has a cylindrical shape.

7. The ship hull according to claim 1, wherein the tenon is screwed to the first frame.

8. The ship hull according to claim 2, wherein the pin includes a threaded portion adapted to engage into a tapped portion of the transverse housing of the second frame.

9. The ship hull according to claim 3, wherein the pin includes a threaded portion adapted to engage into a tapped portion of the transverse housing of the second frame.

10. The ship hull according to claim 2, wherein the tenon has a proximal portion having a suitable size for insertion without play into the mortise and a distal portion having a suitable size for insertion with play into the mortise.

11. The ship hull according to claim 3, wherein the tenon has a proximal portion having a suitable size for insertion without play into the mortise and a distal portion having a suitable size for insertion with play into the mortise.

12. The ship hull according to claim 4, wherein the tenon has a proximal portion having a suitable size for insertion without play into the mortise and a distal portion having a suitable size for insertion with play into the mortise.

13. The ship hull according to claim 2, wherein the tenon has a cylindrical shape.

14. The ship hull according to claim 3, wherein the tenon has a cylindrical shape.

15. The ship hull according to claim 4, wherein the tenon has a cylindrical shape.

16. The ship hull according to claim 5, wherein the tenon has a cylindrical shape.

17. The ship hull according to claim 2, wherein the tenon is screwed to the first frame.

18. The ship hull according to claim 3, wherein the tenon is screwed to the first frame.

* * * * *